US007886506B2

(12) United States Patent
Knoth et al.

(10) Patent No.: US 7,886,506 B2
(45) Date of Patent: Feb. 15, 2011

(54) METHOD OF AUTOMATICALLY FILLING PRESCRIPTIONS

(75) Inventors: Norman D. Knoth, Clearwater, FL (US); Marcia D. Wilkinson, Dunedin, FL (US)

(73) Assignee: QEM, Inc., Largo, FL (US)

( * ) Notice: Subject to any disclaimer, the term of this patent is extended or adjusted under 35 U.S.C. 154(b) by 66 days.

(21) Appl. No.: 12/163,535

(22) Filed: Jun. 27, 2008

(65) Prior Publication Data

US 2009/0321465 A1 Dec. 31, 2009

(51) Int. Cl.
*B65B 5/10* (2006.01)

(52) U.S. Cl. ..... 53/475; 53/55; 53/500; 53/247; 221/1

(58) Field of Classification Search ..... 53/473, 53/475, 55, 57, 493, 498, 500, 235, 237, 53/240, 244, 247, 250; 221/1, 9, 11, 21, 221/67, 123, 129, 197
See application file for complete search history.

(56) References Cited

U.S. PATENT DOCUMENTS 2,457,220 A 12/1948 Fowler et al.
4,018,358 A * 4/1977 Johnson et al. ..... 221/7
5,219,095 A * 6/1993 Shimizu et al. ..... 221/264
5,761,877 A * 6/1998 Quandt ..... 53/155
5,884,806 A * 3/1999 Boyer et al. ..... 221/75
6,006,946 A * 12/1999 Williams et al. ..... 221/9
6,036,812 A * 3/2000 Williams et al. ..... 156/277
6,318,051 B1 * 11/2001 Preiss ..... 53/493
6,394,308 B1 * 5/2002 Yuyama et al. ..... 221/265
6,497,342 B2 * 12/2002 Zhang et al. ..... 221/265
6,578,734 B1 * 6/2003 Coughlin et al. ..... 221/219
6,805,259 B2 * 10/2004 Stevens et al. ..... 221/124
6,925,774 B2 * 8/2005 Peterson ..... 53/152
7,006,894 B2 2/2006 de la Huerga
7,225,597 B1 * 6/2007 Knoth ..... 53/246
2001/0008984 A1 * 7/2001 Omura et al. ..... 700/241
2007/0145066 A1 6/2007 Knoth et al.
2007/0157548 A1 * 7/2007 Knoth ..... 53/244
2008/0017661 A1 * 1/2008 Hutchinson et al. ..... 221/211

* cited by examiner

*Primary Examiner*—Paul R Durand
(74) *Attorney, Agent, or Firm*—Larson & Larson, P.A.; Frank Liebenow; Justin Miller

(57) ABSTRACT

A method of dispensing pills includes (a) inputting a request and (b) loading a cassette having a first pill type into position then (c) positioning a target container beneath that cassette. (d) The cassette is energized to drop one pill. (f) If a pill dropped and there are still more of the current pill to drop, the method continues at step d. (g) If a pill dropped and the number of the current pill has satisfied the request, the method ends. (h) If a pill dropped and a number of the current pill already dispensed type has not satisfied the request, the method continues with step d. (i) If no pill dropped, an operator is informed. (k) If the operator indicates the cassette is empty and another cassette has a same pill, the other cassette is moved to the target location and the method continues from step d.

11 Claims, 12 Drawing Sheets

METHOD OF AUTOMATICALLY FILLING PRESCRIPTIONS

This application is related to U.S. Pat. No. 7,225,597 titled "MACHINE TO AUTOMATE DISPENSING OF PILLS" as well as U.S. patent application Ser. No. 11/317,538, titled "CASSETTE FOR DISPENSING PILLS," and U.S. patent application Ser. No. 11/683,871, titled "METHOD OF DISPENSING PILLS FROM A MOVABLE PLATEN", all of which are incorporated by reference.

BACKGROUND OF THE INVENTION

1. Field of the Invention

The present invention relates to the field of dispensing medicine and more particularly to an apparatus that automatically fills vials and blister packs with medicine in the form of pills, capsules, gel-caps and the like.

2. Description of the Related Art

The dispensing of medicine in the form of pills, capsules, gel-caps, and the like is performed in many ways and in many locations including pharmacies, packaging plants and hospitals. Pharmacies or drug stores employ Pharmacists to fill prescriptions with the prescribed amount of a prescribed medicine or dose. The Pharmacist fills the prescription from a bulk package of medicine into a delivery package sized for the consumer. Although Pharmacists are very careful to dispense the correct quantity of the correct medicine, ever too often, the wrong quantity is dispensed, or worse yet, the wrong medicine is dispensed.

The medicine is often delivered to the consumer in a package that is a container with a lid, for example, a vial or bottle. After counting the prescribed amount of medicine, the Pharmacist funnels the pills into the container, attaches the lid and places a label on the container indicating what medicine is stored inside and information related to the medicine. Again, the transfer of pills into the container creates another opportunity for one or more pills to be lost, thereby not providing the proper amount to the consumer.

With some consumers, it may be difficult to remember which pill to take, when to take it, and even whether they have already taken the pill. To overcome this problem, an array pack was devised with a series of compartment resembling cups or blisters, each "blister" containing one or more pills that are to be taken at the same time. This form of packaging is known as "blister packs," "dose packs," "bingo cards," and "punch cards." In some uses of blister packs, a common pill type (or multiple of a common pill type) is present in each blister of the blister pack, as with many cold medicines. In such, a card with a single dose in each blister is packaged in a simple box with labels and advertising on the outside. In some uses of blister packs, various pill types (or multiple of a common or various pill types) are present in each blister of the blister pack. For example, a blister pack may have 28 compartments with a first pill type in every compartment to be taken one a day and a second pill type in every $7^{th}$ compartment to be taken once a week.

Although a huge benefit to the consumer, filling the blister pack with a prescription involves the Pharmacist sitting down and laboriously dispensing the doses by hand into the individual blisters of the pack, then sealing the back. Furthermore, for prescriptions in which the dosage varies by day, extra attention to detail is required because each blister may have different quantities of pills or pills of a different strength or a combination of such, again feeding into the probability of error.

Presently, automation equipment is available for automatically filling prescriptions from a plurality of pill storage bins (or cassettes). Each storage bin is filled with a supply of a given medicine in pill, capsule or gel-cap form. The storage bin has an electromechanical dispensing control and the dispensing control is controlled by a machine control that has, for example, a user interface for the Pharmacist to enter the medicine name, strength and quantity, thereby initiating the dispensing of that number of pills. The pills are then directed into a vial.

The art of filling containers with pills is quite old, going back to U.S. Pat. No. 2,457,220 to Fowler, et al issued Dec. 28, 1948; which is hereby incorporated by reference and describes a motorized pill dispensing machine. This machine has one storage area for a supply of pills that are thereafter handled by the machine in groups of a known quantity. As the machine rotates, the pills fall into receptacles numbering that known quantity, then as it further rotates, that number of pills falls through an opening, into a funnel and then into a pill container in the shape of a bottle or vial. This device is limited to dispensing a fixed quantity of a single type of pills into bottles.

U.S. Pat. No. 6,318,051 B1 to Preiss, issued Nov. 20, 2001; which is hereby incorporated by reference describes a device for dispatching singular items from a single supply station into product packs (blister packs) of the same type and is useful in an assembly line process of filling blister packs with a single medication. This device is limited to dispensing a single type of pill into a single type of blister pack. Likewise, U.S. Pat. No. 6,805,259 B2 to Stevens, et al, issued Oct. 19, 2004; hereby incorporated by reference, also describes a tablet dispenser that dispenses tablets from multiple reservoirs into blister packs. Although not limited to one medication as the previous patents, this device is limited to dispensing only into blister packs.

U.S. Pat. No. 6,925,774 B2 to Peterson, issued Aug. 9, 2005 is hereby incorporated by reference. It describes a machine a machine for filling blister package cavities. This device does not fill vials and to do so, a pharmacy would need to purchase a second machine.

U.S. Pat. No. 7,006,894 to de la Huerge, issued Feb. 28, 2006 is hereby incorporated by reference. This patent describes a device for filling a medication cassette which is then provided to a patient in a hospital setting. The disclosed device does not fill vials and/or blister packs from a plurality of canisters.

Unfortunately, the prior art does not anticipate and properly correct situations in which either the supply of pills in the cassette is depleted or if a given target package (blister pack or vial) is not large enough to hold the desired number of pills.

What is needed is a method and apparatus that will accurately fill a prescription from a plurality of cassettes into a target package (either a vial or into a blister pack) and properly recover when the cassette is empty and/or the target package is full.

SUMMARY OF THE INVENTION

An objective of the present invention is to provide a method of detecting an empty cassette, notifying the operator and, if another cassette holds the same medication, automatically selecting the other cassette.

Another objective of the present invention is to provide a method of detecting when a target package is at capacity, notifying the operator and, after the operator removes the target package that is at capacity, resuming the fill operation for the remainder of the number of pills desired.

In one embodiment, a method of dispensing pills is disclosed including (a) inputting a request (e.g., a prescription such as a pill type, quantity, etc.) that has at least one pill type and a pill count associated with each pill type. (b) loading a cassette having a first pill type of the pill types into a position over a target location then (c) positioning a target container beneath that target location. Next, (d) the cassette is energized to drop one pill into the target container at the target location. (e) Whether a pill dropped from the cassette into the target container is detected. (f) If a pill dropped from the cassette into the target container and there are still more current pill type to drop into the target container, the method continues at step d. (g) If a pill dropped from the cassette into the target container and the number current pill type has satisfied the request, the method ends. (h) If a pill dropped from the cassette into the target container and a number of the current pill already dispensed type has not satisfied the request, the method continues with step d. (i) If no pill dropped, an operator is informed of such and (j) if the operator indicates that there are still pills in the cassette, a jammed cassette is processed. (k) If the operator indicates the cassette is empty and another cassette has a same pill type, the another cassette is moved to the target location and the method continues from step d. (l) If the operator indicates the cassette is empty and there is no cassette having a same pill type, the operator is instructed to refill the cassette and once (m) the cassette is refilled by the operator, the method continues with step d.

In another embodiment, a method of dispensing pills from a machine is disclosed including (a) inputting a request including a pill type, a pill count and a target container capacity then (b) loading a cassette having pills of the pill type over a target location and (c) loading a target container beneath the target location. Next, (d) the cassette is energized to drop one of the pills into the target container at the target location and it is (e) detected if a pill dropped from the cassette into the target container. (f) If a pill dropped from the cassette into the target container and there are still more current pill type to drop into the target container and the target container is not full, the method continues with step d. (g) If a pill dropped from the cassette into the target container and the number of the current pill type has satisfied the request, the method is finished. (h) If a pill dropped from the cassette into the target container and there are still more of the current pill type to drop into the target container and the target container is not full, the method continues with step d. (i) If a pill dropped from the cassette into the target container and the number of the current pill type has not satisfied the request and the target container is full then (j) the operator is signaled to provide a new container at the target location and the method (k) waits for the operator to provide the new container at the target location and once the new container is provided, the method (l) continues with step d.

In another embodiment, a method of dispensing pills from a machine is disclosed including (a) inputting a request including a pill type, a pill count and a target container capacity then (b) loading a cassette having pills of the pill type over a target location and (c) loading a target container beneath the target location. Next, (d) the cassette is energized to drop one of the pills into the target container at the target location and it is (e) detected if a pill dropped from the cassette into the target container. (f) If a pill dropped from the cassette into the target container and there is still more of the current pill type to drop into the target container and the target container is not full, the method continues with step d. (g) If a pill dropped from the cassette into the target container and the number of the current pill type has satisfied the request, the method is finished. (h) If a pill dropped from the cassette into the target container and there are still more of the current pill type to drop into the target container and the target container is not full, the method continues with step d. (i) If a pill dropped from the cassette into the target container and the number of the current pill type has not satisfied the request and the target container is full then (j) the operator is signaled to provide a new container at the target location and after (k) waiting for the operator to provide the new container at the target location the method (l) continues with step d. Otherwise, (m) if no pill dropped, the operator is informed that no pill dropped and (n) if the operator indicates that there are still pills in the cassette, a jammed cassette is processed. (o) If the operator indicates the cassette is empty and another cassette has a same pill type, the other cassette is moved to the target location and the method continues with step d. (p) If the operator indicates the cassette is empty and there is no other cassette having a same pill type, the operator is instructed to refill the cassette and once (q) the cassette is refilled by the operator, the method continues with step d.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
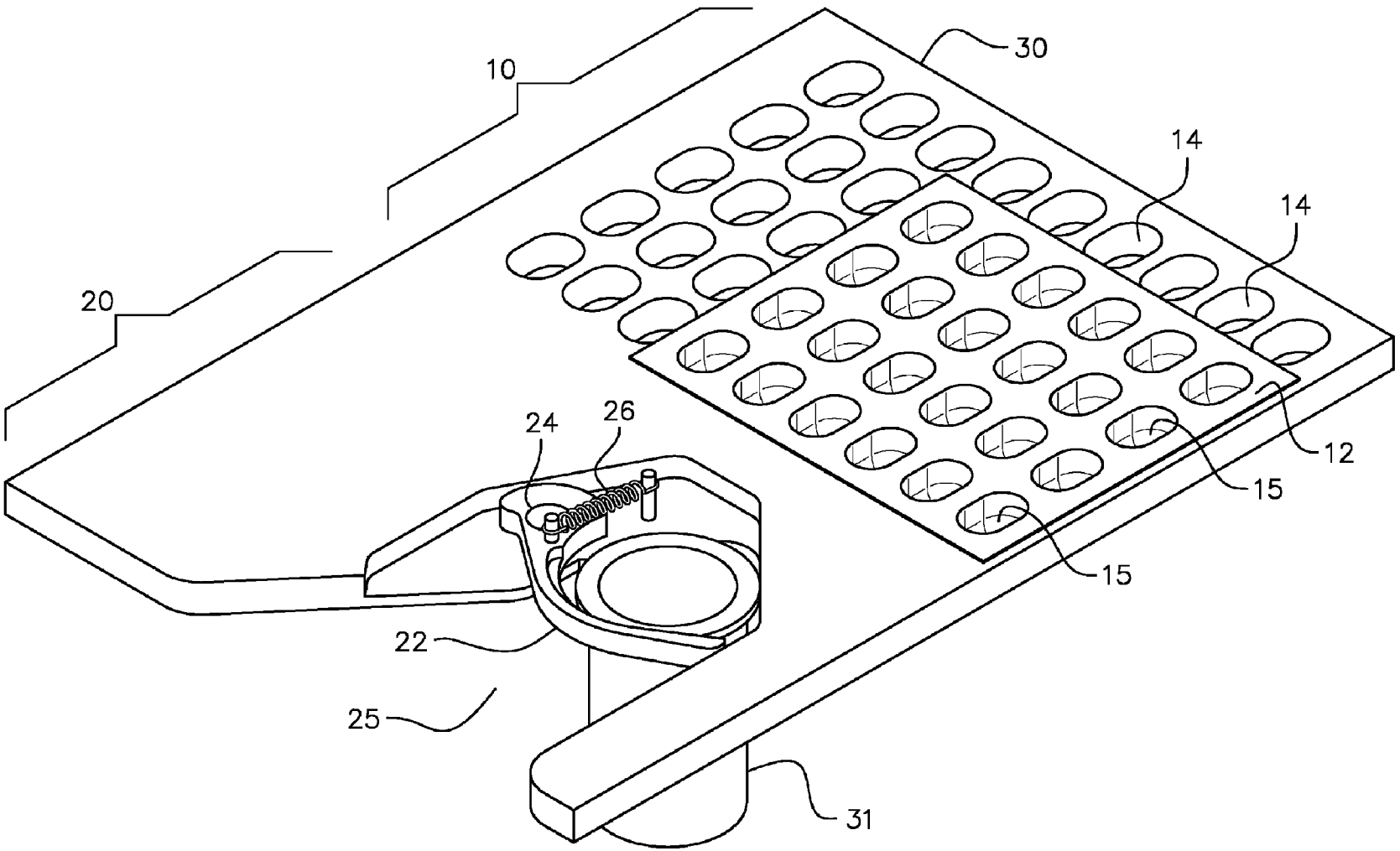
FIG. 1 illustrates a top plan view of a platen of a first embodiment of the present invention.

Reference will now be made in detail to the presently preferred embodiments of the invention, examples of which are illustrated in the accompanying drawings. Throughout the following detailed description, the same reference numerals refer to the same elements in all figures. Throughout the description (including the claims), the word "pill" is used generically. For the purpose of this application, the word pill is used to represent anything that can be dispensed by the device of the present invention and there is no limitation placed upon that which is dispensed. For example, tablets, capsules, caplets and gel-caps can be dispensed as well as coated candy (e.g., placebos). The present invention works well with most any solid object and can be scaled to work for much larger objects as well. Throughout the description (including the claims) the forms of packaging are referred to as vials or blister packs. For the purpose of this application, the word vial is used to represent any container having a single compartment for storing pills including, but not limited to, vials, bottles, tubes and the like. Often, these vials are configured to accept a lid that either snaps in place or screws in place. Blister packs refer to a class of packaging that has multiple compartments, wherein each compartment stores a dose of one or more pills, either the same pills or different pills. Other names for blister packs are, for example, dose packs, bingo cards and punch cards. The individual blisters of the blister pack can be arranged in any fashion, such as a linear series of blisters and a matrix of blisters and may be evenly spaced or not. Often, blister packs are sealed by a thin sheet that adheres to their open side, allowing one blister at a time to be pierced to gain access to the pills within that blister.

Throughout this description, the term cassette refers to a dispenser or canister for a single pill type. The cassette has a storage compartment for the pills and a mechanism for dispensing an accurate count of the pills. Also, the term request is used to define a request to fill a certain set of pills into a target package. For example, a request includes one or more types of pills, quantities of each and destinations for each (e.g., blisters of a blister pack or a vial). In some embodiments, the request also includes a load count or fill count; that is, the maximum number of pills to be deposited in one vial (not necessarily the capacity of the vial). For example, a vial holds 100 pills and the request is for 225 pills and the fill count is set to 75 to place 75 pills in each vial.

Referring to FIG. 1, a top plan view of a platen of a first embodiment of the present invention is shown. The platen frame 30 is made from a substantially flat material. In the preferred embodiment, the platen frame 30 is made from a metal such as steel but in other embodiments, the platen frame 30 is made from a hard plastic. The platen frame 30 has an area for accepting a blister pack 10 and an area for accepting a vial 20. The area for accepting a blister pack 10 has a plurality of holes or indentations 14 in which the individual blisters 15 of a blister pack 12 rest, thereby holding the blister pack 12 in place. In some embodiments, holes 14 are bored through the platen frame 30 while in other embodiments, indentations 14 are carved or formed in the platen frame 30. In one embodiment, the number of holes or indentations 14 matches the number of blisters 15 in the blister pack 12 while in other embodiments, the number of holes or indentations 14 exceed the number of blisters 15 in the blister pack 12. In one embodiment, one or more larger holes or indentations 14 cover an area large enough for more than one of the blisters 15 of a blister pack 12 to rest within it.

The area for accepting vials 20 has a receptacle for holding a vial 31. In one embodiment, the receptacle includes a cut out area 25 in the platen frame 30 and an arm 22 for holding the vial 31. The arm 22 is attached to the platen frame 30 with a pivot 24 and is spring loaded in the direction towards the platen frame 30 by a spring 26 so that the arm can be pulled out by an operator and when released, places a force against the vial 31. This is an example of vial holding designs and many other designs are anticipated by the present invention and known in the art. For example, instead of the cut out 25, a hole is cut in the platen frame 30 sized to fit the outside diameter of the vial 31 for holding the vial 31, but has the limitation that it can only hold one size vial 31.

Figure 2:
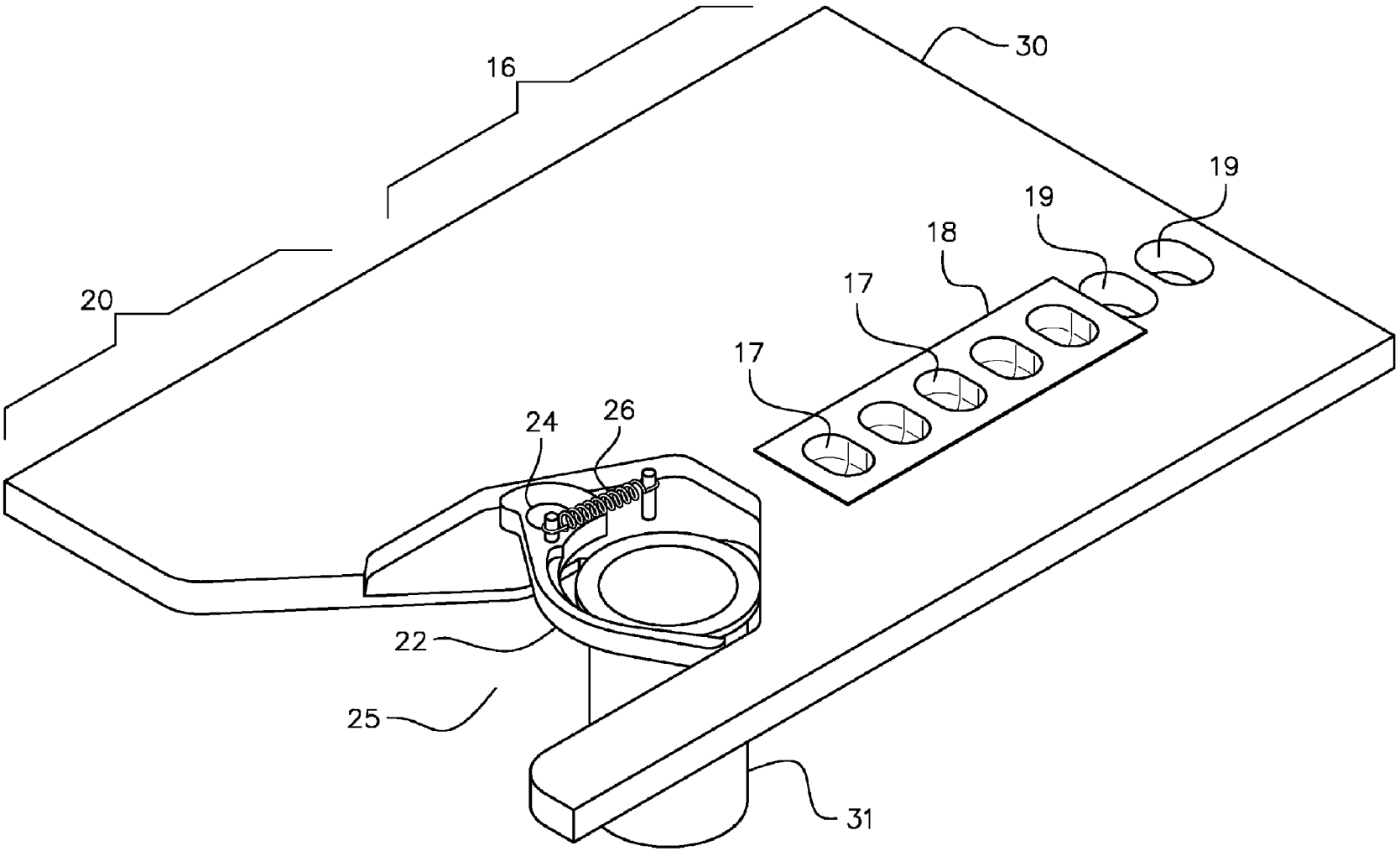
FIG. 2 illustrates a top plan view of a platen of a second embodiment of the present invention.

Referring to FIG. 2, a top plan view of a platen of a second embodiment of the present invention is shown. As in the first embodiment platen frame 30 is a substantially flat platform. In the preferred embodiment, the platen frame 30 is made from a metal such as steel but in other embodiments, the platen frame 30 is made from a hard plastic. The platen frame 30 has an area for accepting a blister pack 16 and an area for accepting a vial 20. The area for accepting a blister pack 16 has a plurality of holes or indentations 19 in which the individual blisters 17 of a blister pack 18 rest, thereby holding the blister pack 18 in place. In some embodiments, holes 19 are bored through the platen frame 30 while in other embodiments, indentations 19 are carved or formed in the platen frame 30. In one embodiment, the number of holes or indentations 19 matches the number of blisters 17 in the blister pack 18 while in other embodiments, the number of holes or indentations 19 exceed the number of blisters 17 in the blister pack 18. In one embodiment, one or more larger holes or indentations 19 cover an area large enough for more than one blister 17 of a blister pack 18 to rest within. In this embodiment, the blisters 17 are arranged in a single row. This arrangement accommodates blister packs 18 that have a small number of blisters, for example seven, one for each day of the week. In one embodiment, it is preferred, but not required, that the center of each hole or indentation 19 correspond to the center of the vial 31 so that the platen need only be moved in one direction when changing between blister packs 18 and a vial 31.

The location for accepting vials 20 has a receptacle for holding the vial 31 while it is being filled. In one embodiment, the receptacle includes a cut out area 25 in the platen frame 30 and an arm 22 for holding the vial 31. The arm 22 is attached to the platen frame 30 with a pivot 24 and is spring loaded in the direction towards the platen frame 30 by a spring 26 so that the arm can be pulled out by an operator and when released, places a force against the vial 31.

Figure 3:
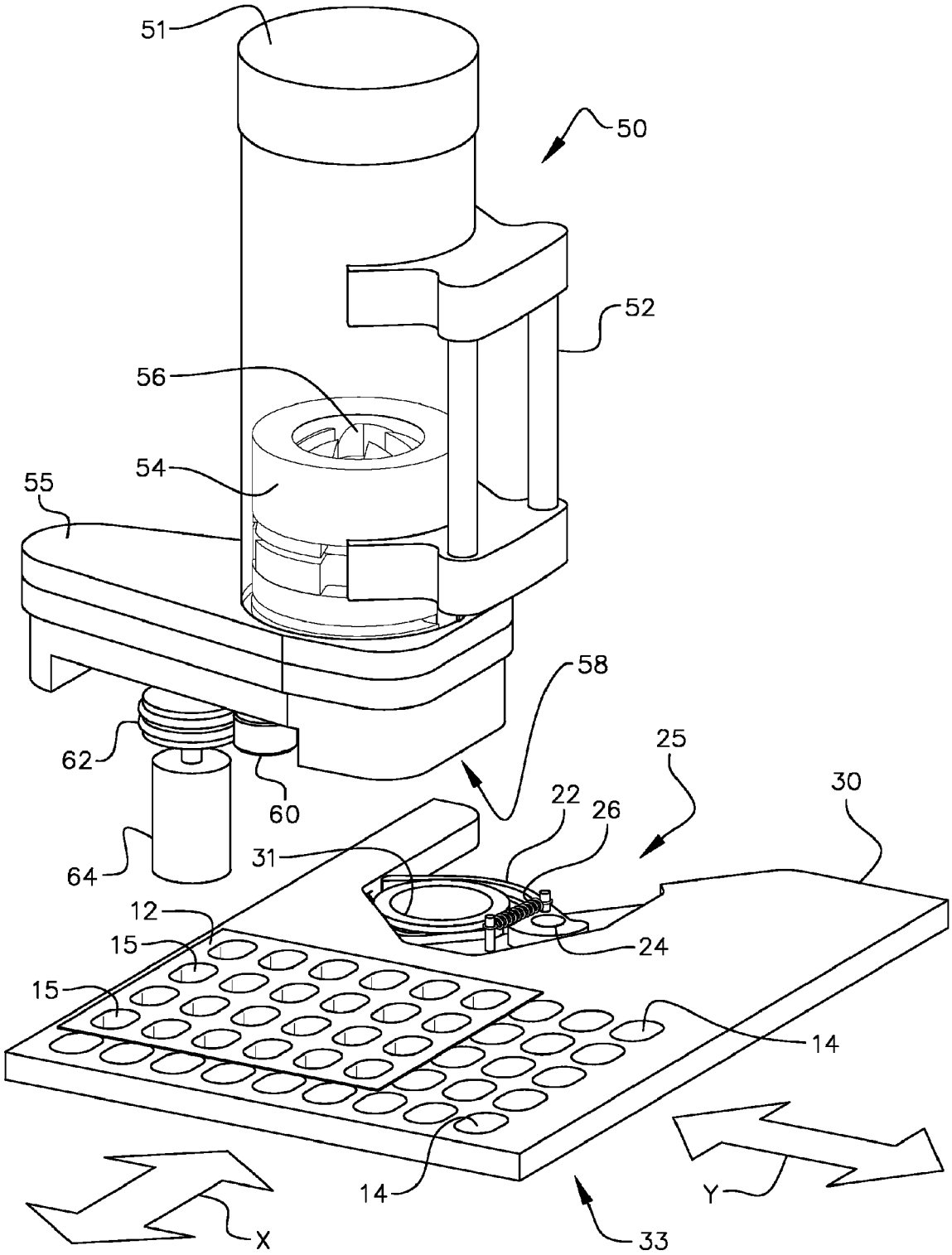
FIG. 3 illustrates a perspective view of the first embodiment of the present invention with a dispensing unit.

Referring to FIG. 3, a perspective view of the first embodiment of the present invention with a cassette dispensing unit is shown. The movable platen 33 is a platen as described in the previous description and is movable in at least one direction under the control of at least one drive mechanism. In some embodiments, the drive mechanism is one or two servo motors, moving the movable platen 33 in either an X direction or and X and Y direction. A movable platen 33 designed to hold a blister pack 18 with a single row of blisters need only move in an X direction (see FIG. 2) while a movable platen 33 designed to hold a blister pack 12 with multiple rows, each having multiple blisters, moves in both an X and Y direction to index to each of the blisters. In other embodiments, the control mechanism is one or two motors and one or two worm gears. There are many ways known in the art to accurately drive a surface such as the movable platen 33 in both an X direction and a Y direction and are all anticipated by the present invention.

In FIG. 3, the platen 33 moves in the X direction and the Y direction to position either one of the blisters or the vial beneath a target location 58 of a cassette 50 filled with pills. This position is referred to as the target location because the pills drop from the cassette 50 into whatever is positioned under this location. Once positioned to the target location 58, the cassette 50 is controlled to drop a required quantity of pills and, since the desired blister 15 or vial 31 is positioned directly beneath the target location, the pills drop into either the blister 15 or the vial 31.

The cassette 50 is shown for completeness and can be any form of dispensing device known in the industry, including the Cassette for Dispensing Pills as described in a co-pending patent application. In that application, cassette 50 has a handle 52 to enable an operator or a robot to remove the cassette from the automated filling machine (not shown) and a lid 51 to keep pills in and contaminates out of the cassette 50. The pills in the cassette are funneled toward a dome-shaped vane 56 by a cassette vane top ring 54 and into an indexing mechanism that dispenses pills in single file, periodically, as the cassette drive wheel 60 is rotated by a motor 64 and a motor drive wheel 62. The gear housing 55 holds the gear system used to drive the indexing mechanism that is coupled to a drive wheel 60. This is a simplified description of an exemplary mechanism for dispensing a known quantity of pills to a specific location and many other mechanisms for dispensing pills to a specific location are known in the art. One such mechanism includes a cassette for holding the pills and a shutter mechanism that opens to drop a single pill to the target location.

Figure 4:
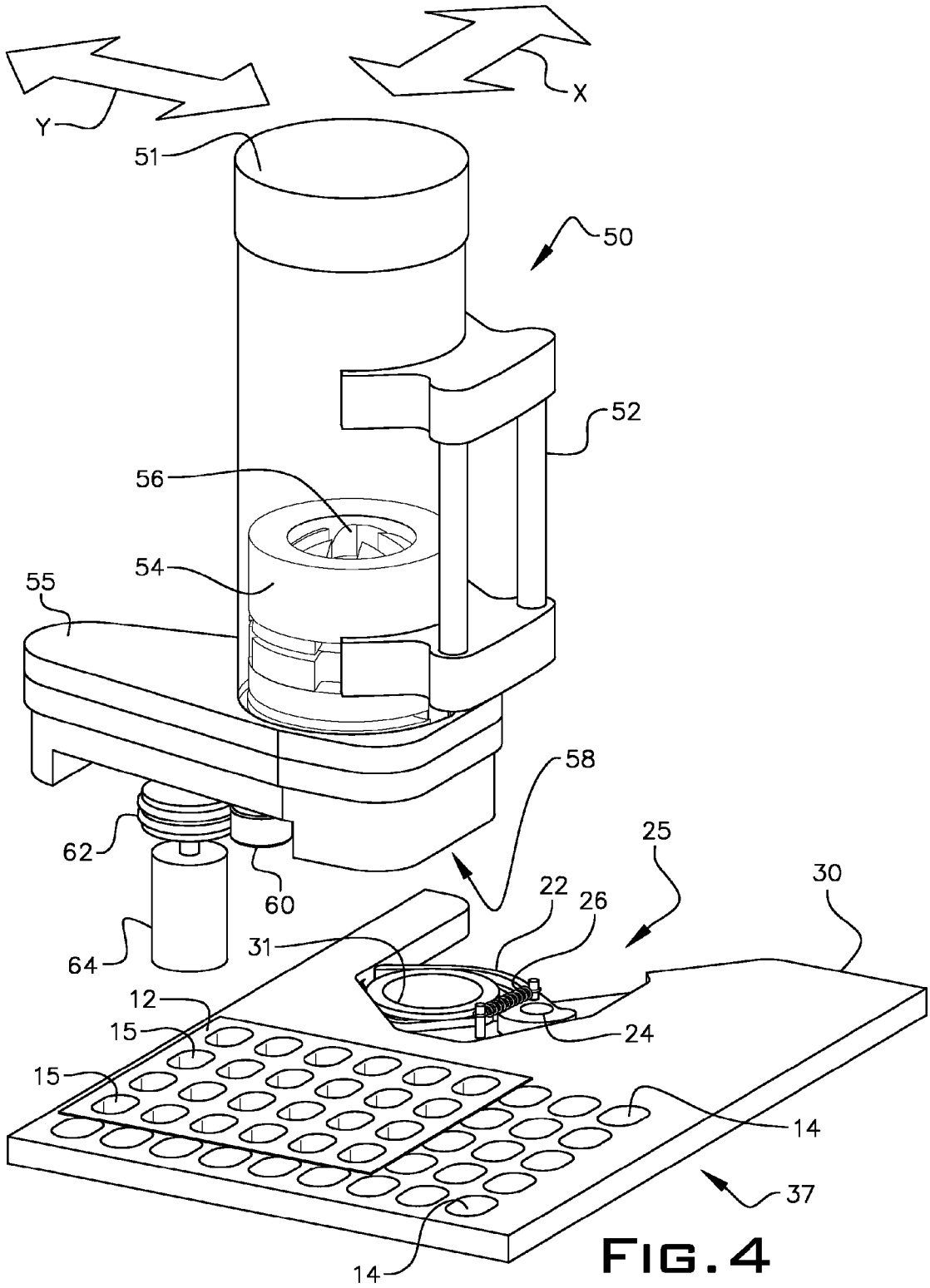
FIG. 4 illustrates a perspective view of a third embodiment of the present invention with a moveable cassette.

Referring to FIG. 4, a perspective view of a third embodiment of the present invention with a movable cassette dispensing unit is shown. The platen 37 is a platen as described in the previous description except that in this embodiment, the platen 37 is stationary. Instead of moving the platen 37, the drive mechanism moves the cassette and in some embodiments, moves the entire cassette carousel, thereby positioning the dispensing cassette 50 over the target blister 15 or vial 31. In some embodiments, the control mechanism is one or two servo motors, moving the cassette 50 in either an X direction or an X and Y direction. If the stationary platen 37 is designed to hold a blister pack 12 with a single row of blisters 15 (see FIG. 2), the control mechanism need only move in an X direction while if the stationary platen 37 is designed to hold a blister pack 12 with multiple rows, each having multiple blisters 15, then the control mechanism needs to move the cassette in an X and Y direction to index to each of the blisters. In one embodiment, the control mechanism is one or two motors and one or two worm gears. There are many ways known in the art to accurately drive an object such as the cassette 50 in both an X direction and a Y direction and are all anticipated by the present invention.

In FIG. 4, the cassette 50 moves in the X direction and the Y direction to position either one of the blisters 15 or the vial 31 beneath a cassette 50 filled with pills. This position is referred to as the target location 58. Once the cassette is positioned to the target location 58, the cassette 50 is controlled to drop a required quantity of pills and since the desired blister 15 or vial 31 is positioned directly beneath the target location 58, the pills drop into either the blister 15 or the vial 31.

The cassette 50 is shown for completeness and can be any form of dispensing device known in the industry, including the Cassette for Dispensing Pills as described in a co-pending patent application. In that application, cassette 50 has a handle 52 to enable an operator or a robot to remove the cassette from the automated filling machine (not shown) and a lid 51 keeping pills in and contaminates out of the cassette 50. The pills in the cassette are funneled toward a dome-shaped vane 56 by a cassette vane top ring 54 and into an indexing mechanism that dispenses pills in single file, periodically as the cassette drive wheel 60 is rotated by a motor 64 and a motor drive wheel 62. This is a simplified description of an exemplary mechanism for dispensing a known quantity of pills to a specific location and many other mechanisms for dispensing pills to a specific location are known in the art. One such mechanism includes a cassette for holding the pills and a shutter mechanism that opens to drop a single pill to the target location.

Figure 5:
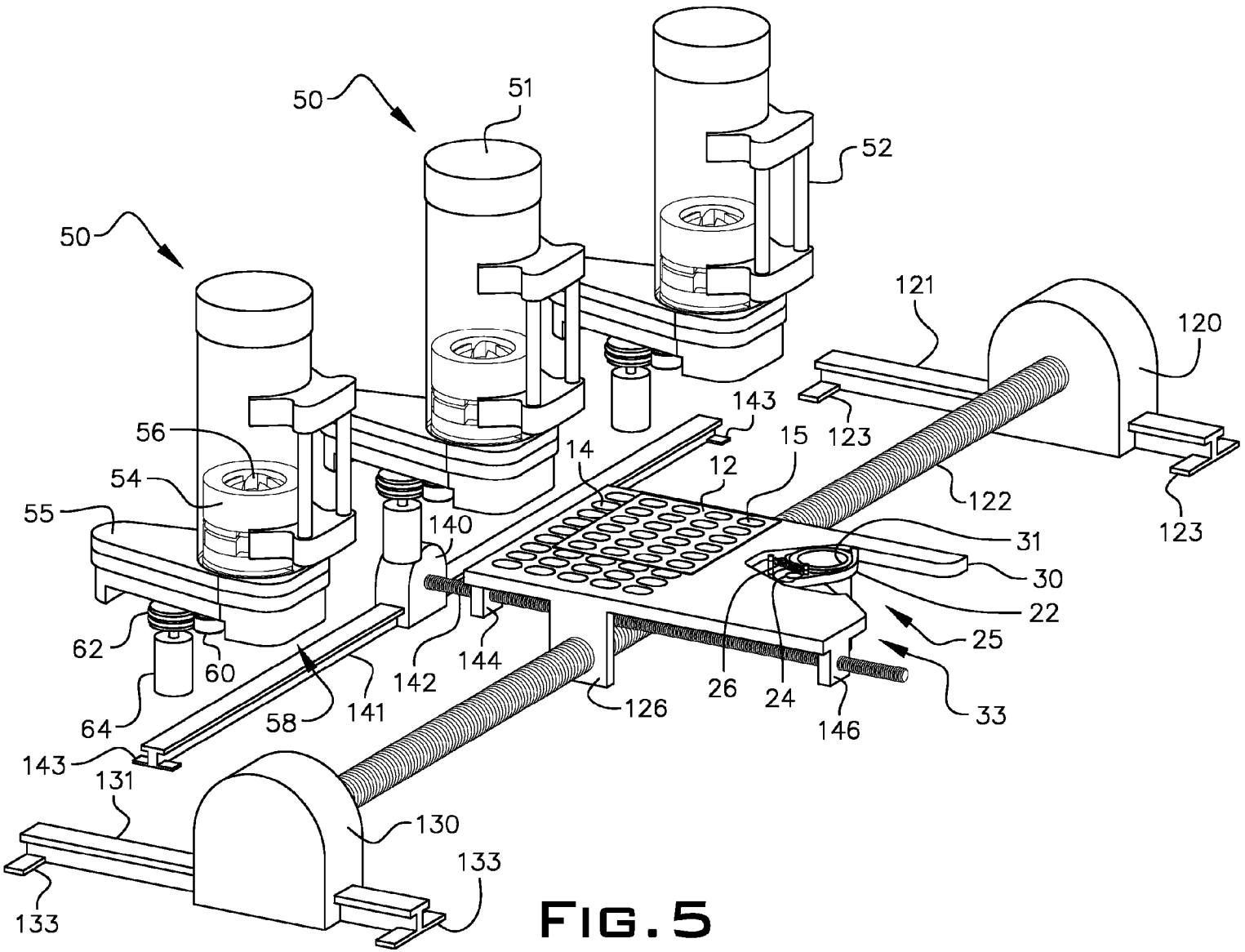
FIG. 5 illustrates a perspective view of a fourth embodiment of the present invention with a linear dispensing unit.

Referring to FIG. 5, a perspective view of a fourth embodiment of the present invention with a linear dispensing unit is shown. In this embodiment, the movable platen 33 is driven in an X direction by a first motor 120 coupled to a threaded shaft 122. The threaded shaft 122 is long enough to allow the movable platen 33 to travel under a plurality of cassettes 50. In one embodiment, the threaded shaft 122 is held at an end distal to the first motor 120 by a support 130. The first motor 120 and the support 130 freely travel in they direction by way of rails 121/131. The rails are held in place by anchors 123/133. The threaded shaft 122 interfaces to the platen 33 at a linkage 126 that pulls or pushes the platen 33 along the length of the threaded shaft 122; thereby creating what is known as a worm gear. The cassettes 50 are similar to the previously described cassette, but each cassette in this embodiment has a separate drive motor 64 to cause the dispensing of pills. The first motor 120 is capable of positioning the platen 33 such that the vial 31 or an individual row of blisters 14 align with the target location 58 beneath a selected cassette 50. A second motor 140 travels with the platen 33 in the X direction along another rail 141, the rail is held in place by anchors 143. The second motor 140 positions the platen 33 in the Y direction, so that an individual blister 14 or the vial can be positioned under the target location, at which time, the required number of pills are dropped from the cassette 50. The second motor 140 is coupled to a second threaded shaft 142 that interfaces with the movable platen 33 at linkages 144/146. Either or both of the linkages 144/146 are threaded to mate with the threaded shaft 142 or are bearings. The threaded shaft 142 and the linkages 144/146 form what is known as a worm gear. The mechanism described is just one example of a method of moving a platform in both an X and a Y direction and many others are known in the art.

Figure 6:
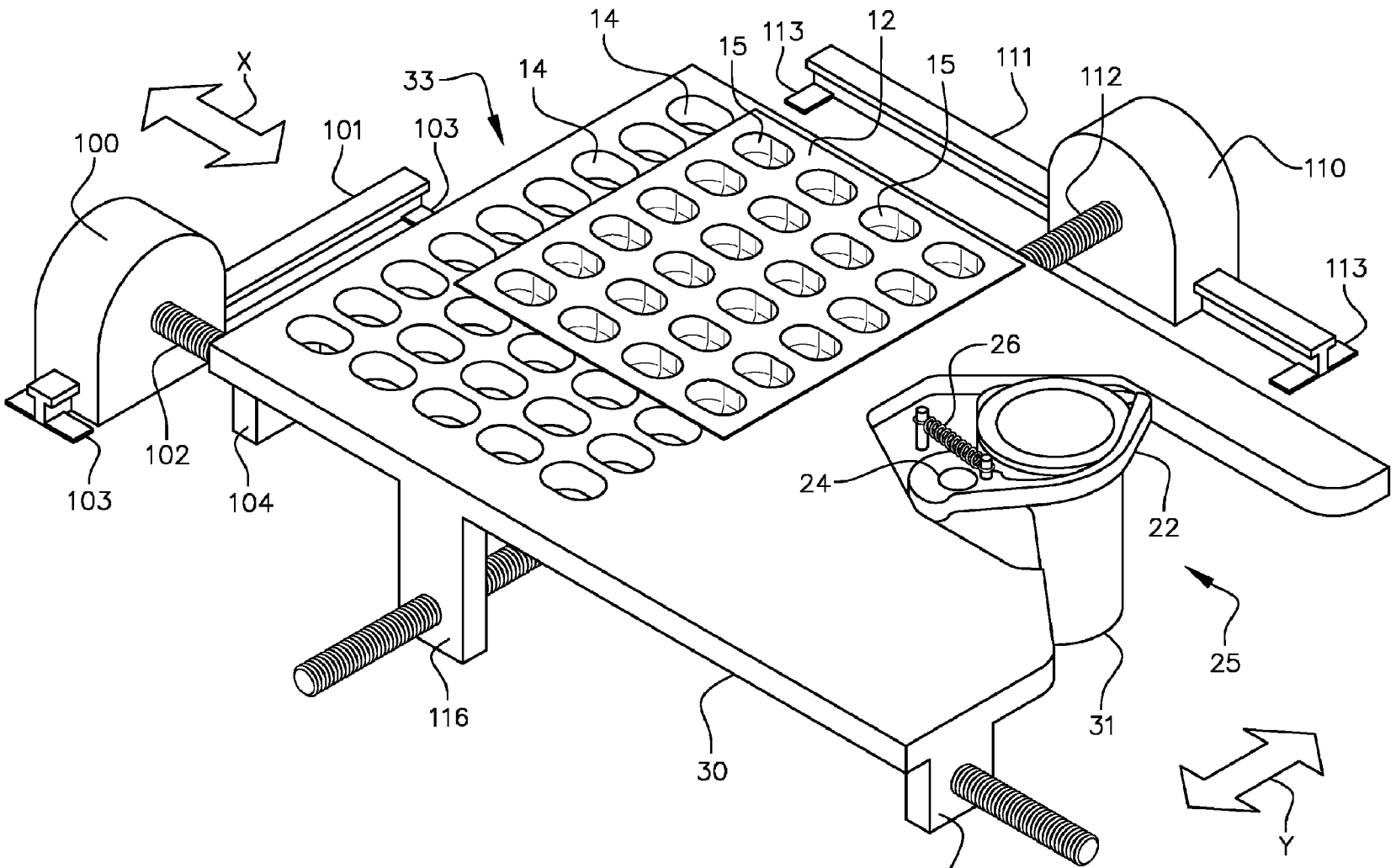
FIG. 6 illustrates a perspective view of the first embodiment of the present invention showing an example of a servo motor drive.

Referring to FIG. 6, a perspective view of the first embodiment of the present invention showing an example of a servo motor drive is shown. The movable platen 33 is made from a substantially flat frame 30. The frame 30 has a plurality of holes or indentations 14 in which the individual blisters of a blister pack 12 rest, thereby holding the blister pack 12 in place. In some embodiments, holes 14 are bored through the frame 30 while in other embodiments, indentations 14 are carved or formed in the frame 30. In this embodiment, the receptacle for holding a vial 31 includes a cut out area 25 in the frame 30 and an arm 22 for holding the vial 31. The arm 22 is attached to the frame 30 with a pivot 24 and is spring loaded in the direction towards the frame 30 by a spring 26 so that the arm can be pulled out by an operator and when released, places a force against the vial 31. In this embodiment, an X servo motor 100 moves the frame 30 in an X direction by turning a threaded shaft 102, in which the threads pass through a threaded opening 104 affixed to the frame 30, thereby forming a worm gear. A distal end of the threaded shaft 102 is supported in some embodiments by a bearing or a threaded opening 106. Also, in this embodiment, a Y servo motor 110 moves the frame 30 in a Y direction by turning a second threaded shaft 112, in which the threads pass through a threaded opening 116 affixed to the frame 30, thereby forming a second worm gear. The X servo motor 100 moves freely in the Y direction along a rail 101 and the rail is held in place by anchors 103. The Y servo motor 110 moves freely in the X direction along a rail 111 and that rail is held in place by anchors 113. In some embodiments, the threaded shaft 112 is supported by a bearing or second threaded opening (not shown).

Figure 7:
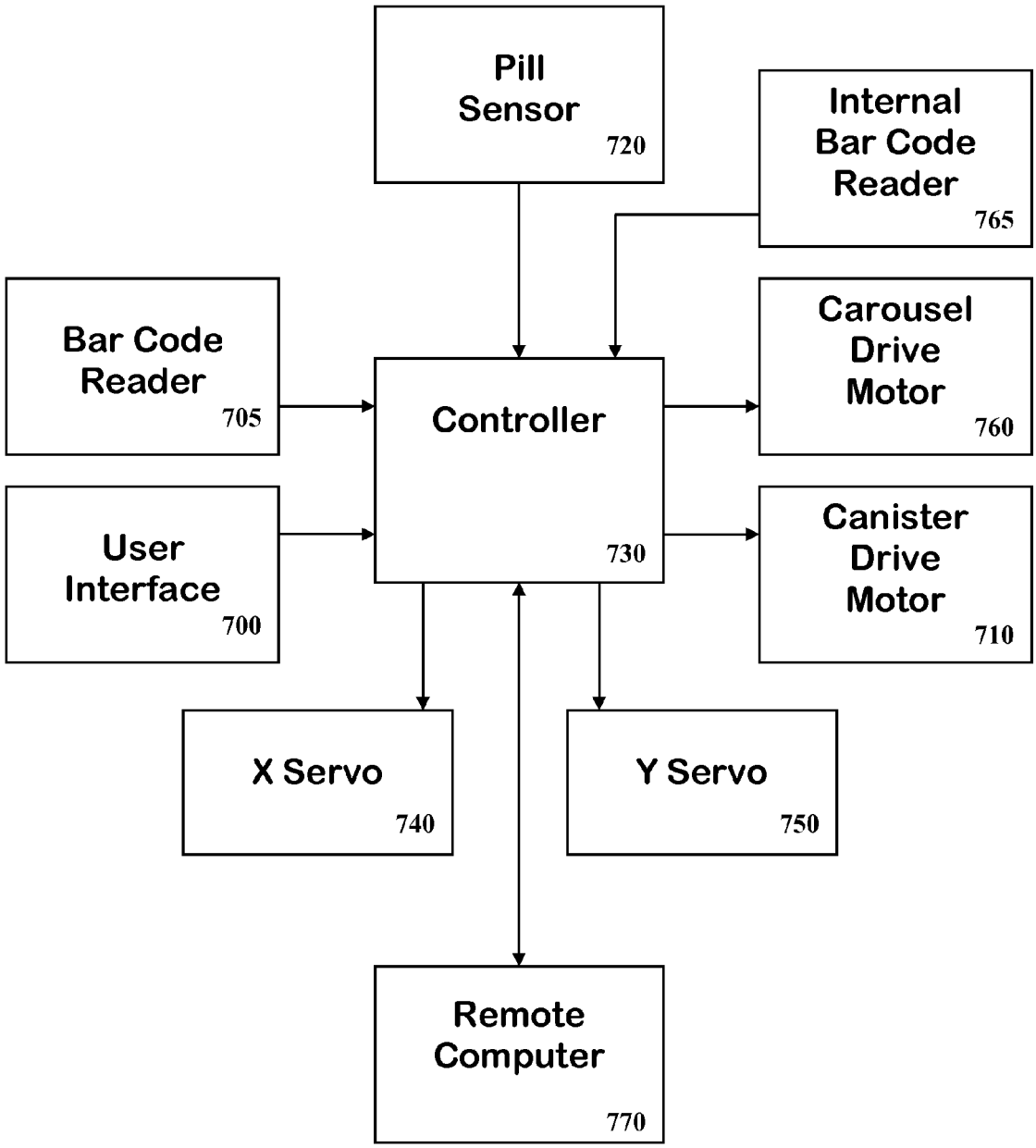
FIG. 7 illustrates a block diagram of the control system of the present invention.

Referring to FIG. 7, a block diagram of the electrical system of the present invention is shown. The controller 730 accepts inputs from the user interface 700, from the bar code reader 705, from a remote computer 770 or any other way of accepting input data as known in the industry. Although many commands and operations are present in most embodiments, the commands of interest to the present invention include a request for dispensing a certain quantity of a desired pill into a package. In most embodiments, requests to dispense pills comes from the bar code reader 705 or the remote computer 770 include a National Drug Code (NDC) identifying the drug to dispense; a quantity; and a package type. The type of package specified is either a vial or blister pack. Once information regarding the medication, the quantity and the desired packaging is ascertained, the cassette containing the medication is moved to the target location using, for example, the carousel drive motor 760. In some embodiments, an internal bar code reader 765 reads a bar code on the cassette to make sure the correct cassette is in position to fill the request. The package is filled using the cassette drive motor 710 to dispense the quantity of pills over a target location. The pill sensor 720 counts the pills and the X-servo 740 and Y-Servo 750 position the packaging under the cassette, allowing the pills to fall into the correct package (either the vial or a blister of the blister pack). If the packaging is a blister pack, the X-servo 740 and Y-Servo 750 are used to step the package in an X and Y direction, sequentially positioning each blister under the cassette to deliver the pill(s) into the individual blisters. In some embodiments (not shown) additional servo motors are deployed to control the machine in different ways, allowing for an increased number of cassettes and/or packaging stations. Details on these are left out to clearly define the inventive part of the present invention. Details of the system operations are described with FIGS. 8 and 9. Note that in this embodiment, the cassettes are located on a carousel but the present invention is not limited to any specific method of positioning the pill supply over the target packaging. For example, in another embodiment, the pill supply cassettes are arranged in linear fashion and instead of a carousel drive, a linear drive such as a worm gear is used to position the cassette. In some embodiments, vertical stacking is used, but care must be taken to limit contamination of one medicine to another.

Figure 8:
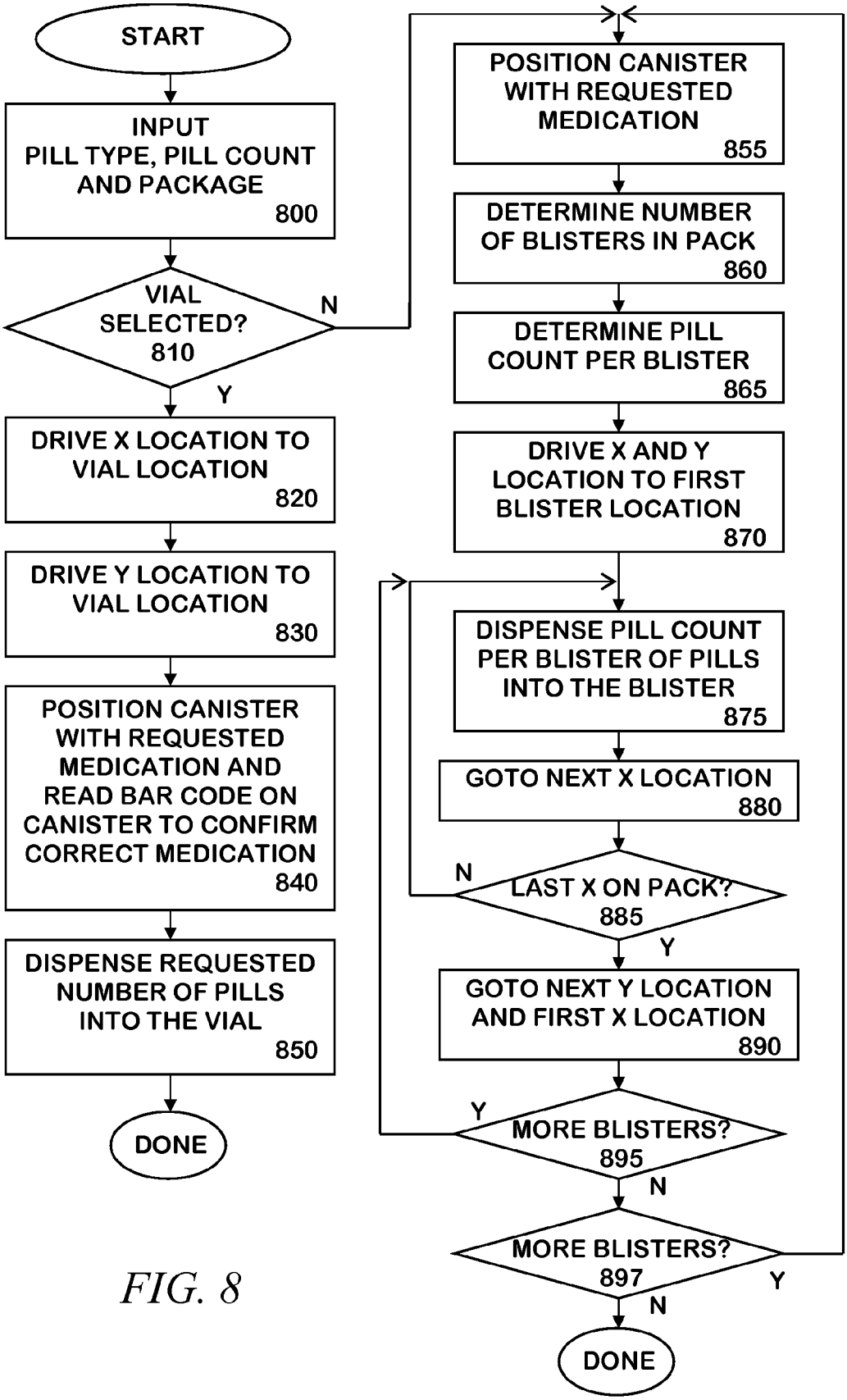
FIG. 8 illustrates a flow chart of the control system of the present invention.

Referring to FIG. 8, a flow chart of the operation of the present invention is shown. As in FIG. 7, the prescribed medication (pill type), pill count and target packaging is obtained 800 from a user interface 700, read from the bar code reader 705 or imported from the remote computer 770. If the packaging selected is a vial 810, then the X-servo 740 is used to move the platen in the X direction 820 and the Y-servo 750 is used to move the platen in the Y direction 820 to a position where the vial will be at the target location. Then the cassette with the requested pill is positioned over the vial 840 and the correct number of pills is dispensed into the vial 850. Details of pill dispensing are described in FIG. 9. In some embodiments, a bar code on the cassette is read 840 by the internal bar code reader 765 as a safety precaution to make sure the correct medicine is dispensed.

If the packaging selected is not a vial 810 (e.g., it is a blister pack), then the cassette with the requested pill is positioned over the target location 855. The number of blisters in the blister pack is determined 860 and, either from the number of blisters or a number included in the input data, the number of pills per blister is determined 865. In one embodiment, the number of pills per blister is set to one. In another embodiment, the number of pills per blister is set to the total number of pills to be dispensed divided by the total number of blisters. After that, the X-servo 740 is used to move the platen in the X direction and the Y-servo 750 is used to move the platen in the Y direction to a position where the first blister is at the target location 870. The correct number of pills is dispensed into the blister at the dispensing location 875. Details of pill dispensing are described in FIG. 9. Next, the platen is positioned so the next blister is under the target location (next in the X direction) 880 and it is determined if that location is beyond the end of the blister pack 885. If it is not at the end of the blister pack, then the prior three steps (875-885) are repeated until an end is reached. Once at the end, the platen is positioned so the first blister (first X) of the next row of blisters (next Y) is under the target location 890. If there is another row on the blister pack 895, then the previous 5 steps are repeated (875-895) filling that row and any other rows. If there isn't another row, then the process of filling the blister pack with a first medication is finished. If there is another medication to fill into the blister pack 897, then the previous ten steps (855-897) are repeated for the next medication until all required medications are inserted into each blister of the blister pack. In other embodiments, some of the steps are performed in different order.

Figure 9:
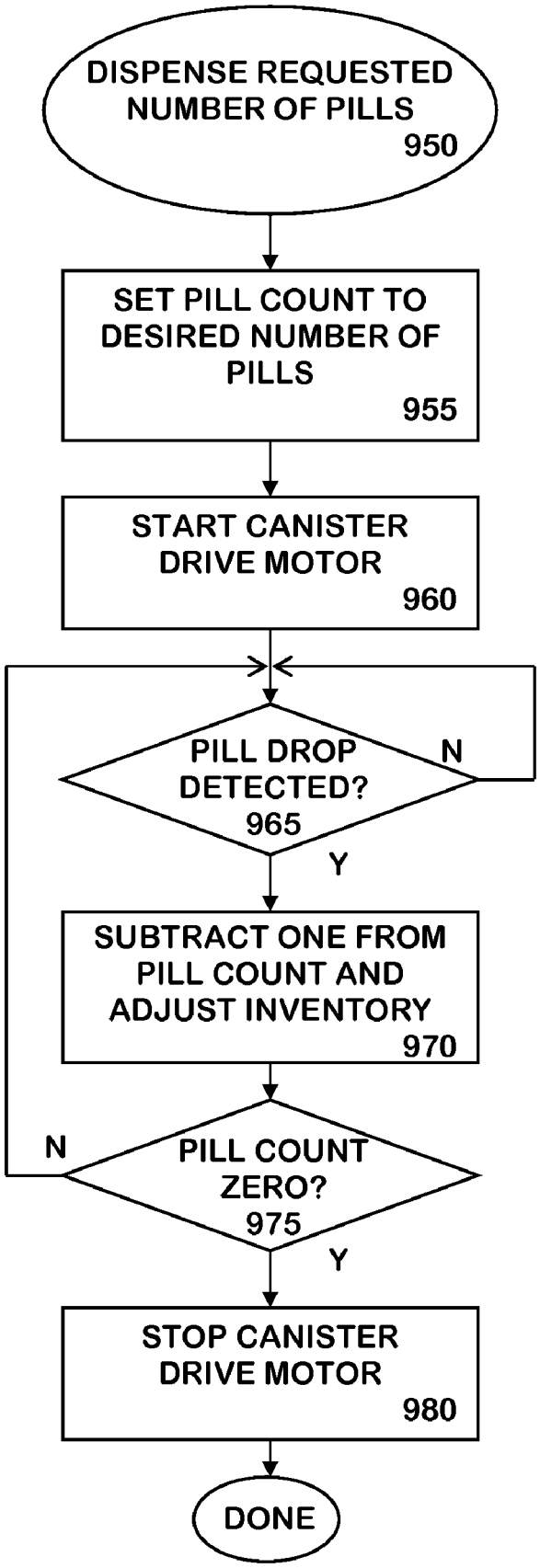
FIG. 9 illustrates a second flow chart of the control system of the present invention.

Referring to FIG. 9, a flow chart of the operation of filling a request for a number of pills 950 of the present invention is shown. A counter is set to the desired number of pills 955 and the cassette drive motor is started 960. In the operation of this embodiment, the cassette drive motor operates a start/stop gear within the cassette, such that the continuous rotation of the motor is converted into a rotate/pause cycle of the cassette and at each pause, one pill should fall from the cassette at the target location. In other embodiments, other mechanisms are used to drop a pill from a cassette including electromagnetic shutters and the like. These alternate embodiments will also work as this is a sample process for dropping a known quantity of pills. Continuing, a detection loop waiting for a signal that a pill has dropped loops until a pill drop is detected 965. Note that pill drop detectors are known in the industry; one example is a light source and light detector, whereby the pill interferes with the light, thereby creating an electrical signal at the detector.

Once a pill drop has been detected 965, the pill count is decremented 970 and in some embodiments, the inventory adjusted 970. In some embodiments, an inventory of the contents of each cassette is maintained, and if so, at this point the inventory is adjusted to reflect one pill being removed from the inventory. If the pill count is still not zero 975, the previous three steps (965-975) are repeated until the correct count of pills has been counted, at which time the cassette drive motor is stopped 980.

The above description of one possible device for dispensing pills is shown as an example. There are many different devices for dispensing pills into either vials or blister packs known in the industry, all of which are included in the present application. The present invention provides for methods that improve the usability of such devices.

Figure 10:
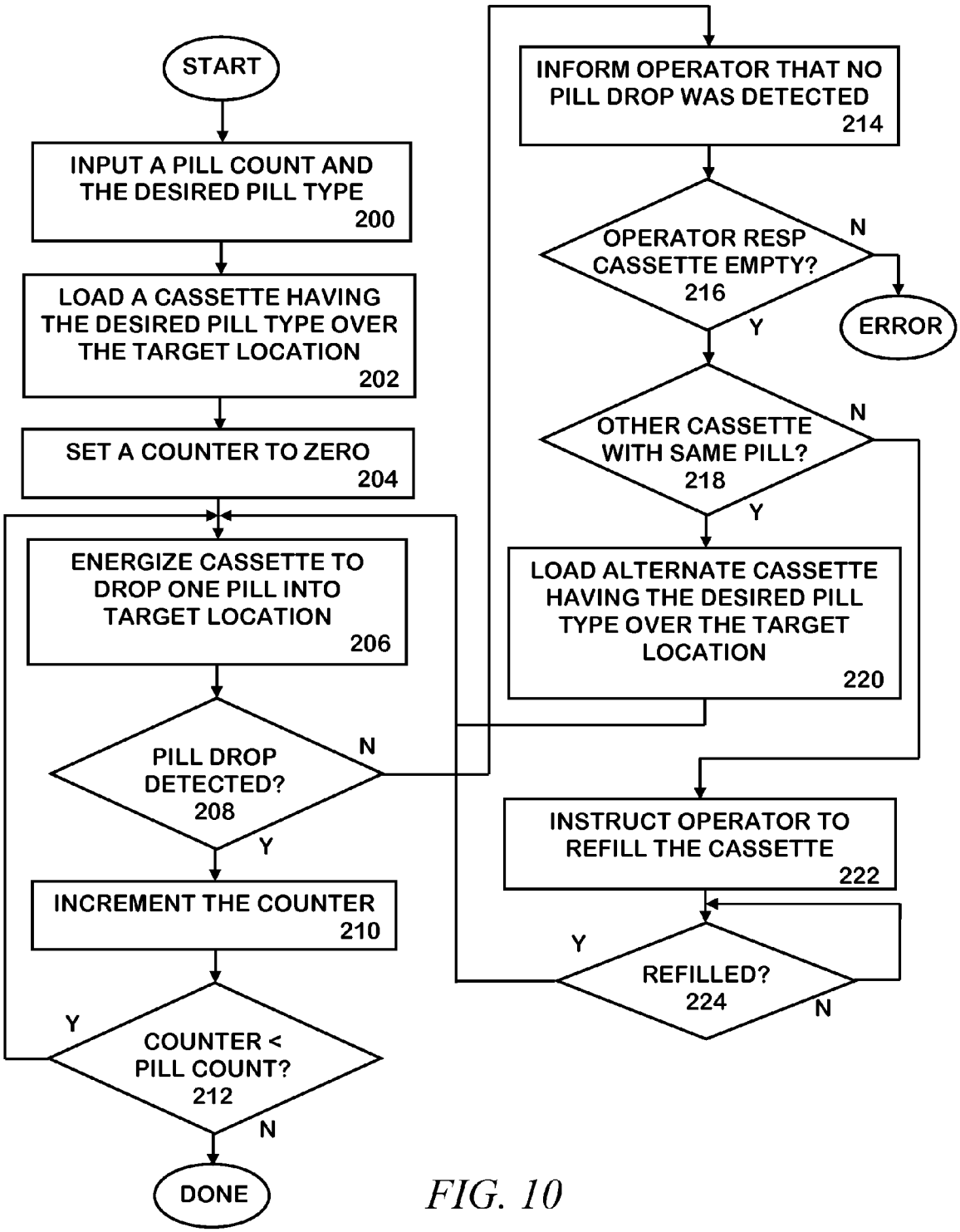
FIG. 10 illustrates a flow chart of the control system for handling an empty cassette of the present invention.

Referring to FIG. 10, a flow chart of the control system for handling an empty cassette of the present invention is shown. This process provides for changing the cassette to another cassette having the same type of pills and/or refilling the cassette and resuming in filling the request into the target package. Flow begins with (a) accepting a pill count and desired pill type 200 (e.g., 25 mg penicillin). A cassette having the selected pill type is (b) loaded (e.g., rotated or picked by the dispensing device) and placed over the target location 202 where the pills from the cassette will be dispensed to the target package. A counter is (c) set to zero 204. (d) The cassette is then energized to drop one pill into the target package at the target location 206 and (e) a test is performed to make sure the pill dropped 208. If the pill dropped 208, the (f) counter is incremented 210 and (g) if the counter is still less than the pill count 212, steps d-g are repeated until the pill count is reached, wherein the counter will equal the pill count and the process of filing the request will be complete. If the pill didn't drop 208, (h) a message or indicator is displayed to the operator indicating that the pill didn't drop and requesting a reason 214. (i) If the reason is not that the cassette is empty, an error occurred 216; perhaps the pills jammed. (j) If the reason is that the cassette is empty 216, then (k) it is determined if another cassette contains the same pill 218. If another cassette contains the same pill 218, then (l) that cassette is loaded over the target location 220 and the process continues at step d. If no another cassette contains the same pill 218, then (m) the operator is instructed to refill the canister 222. (n) Once refilled 224, the process continues with step d.

Figure 11:
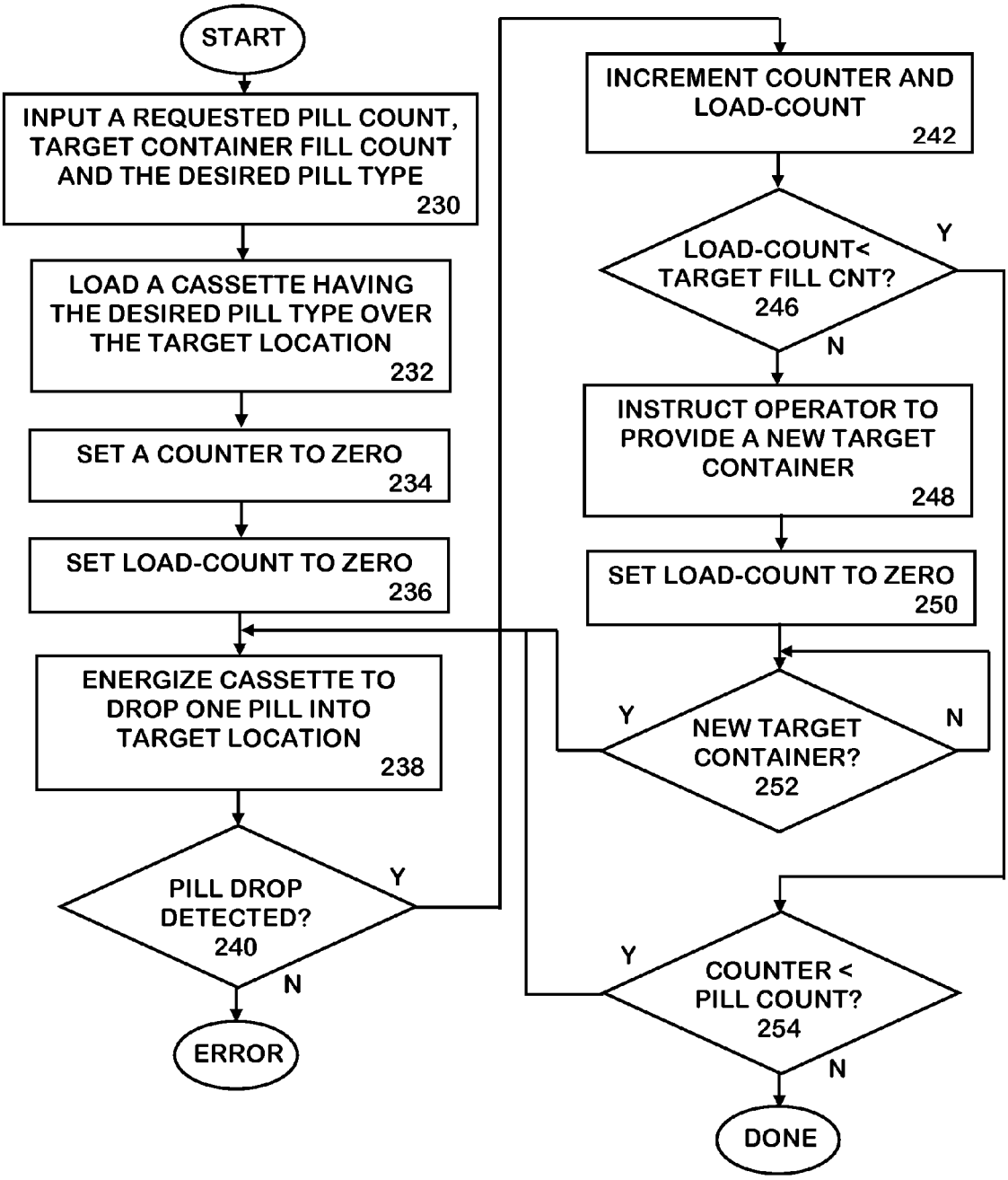
FIG. 11 illustrates a flow chart of the control system for handling a full target package of the present invention.

Referring to FIG. 11, a flow chart of the control system for handling a full or satisfied target package of the present invention is shown. This process provides for handling a container or vial that either cannot hold the entire request (e.g., 900 pills are required but the largest container/vial only holds 300 thereby requiring three vials/containers), or when it is desired to fill the request is several containers. This Flow begins with (a) accepting a pill count, a target container load count and desired pill type 230 (e.g., 25 mg penicillin). A cassette having the selected pill type is (b) loaded (e.g., rotated or picked by the dispensing device) and placed over the target location 232 where the pills from the cassette will be dispensed to the target package. A counter is (c) set to zero 234. A load-count is also (d) set to zero 236. (e) The cassette is energized to drop one pill 238. (f) If the pill drop is not detected 240, an error occurred or the process of FIG. 10 is performed to reload or change cassettes. (g) If the pill drop is detected 240, the counter and the load counter are incremented 242. (h) If the load count is greater than or equal to the target container load count 246 (e.g., the target container contains the desired amount), the operator is instructed to provide a new target container 248 and the load counter is set to zero 250 (e.g., there are no pills in the new target container). In some embodiments, instead of instructing the operator to provide a new target container 248 a mechanism automatically removes the loaded target container and inserts an empty target container. (i) Once the new target container is provided 252, the process of dispensing pills continues at step e. If the load count was less than the target container load count 246, then it is determined if the counter is less than the pill count 254 (number of pills to dispense). If the counter is less than the pill count, then the loading process continues at step e. If the counter is greater than or equal to the pill count, then the total number of pills has been dispensed and the process is complete.

Figure 12:
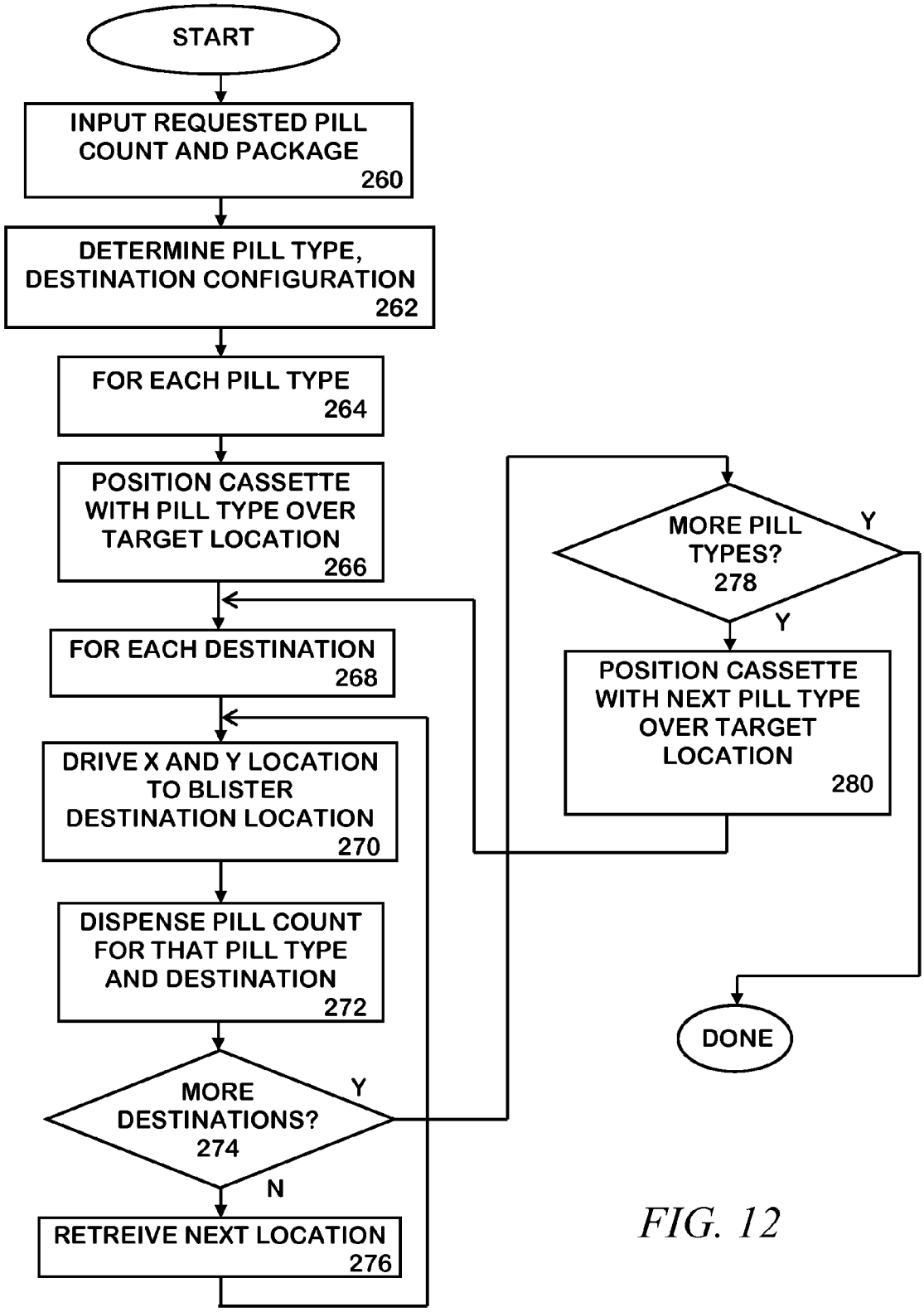
FIG. 12 illustrates a flow chart of the control system for depositing pills in random locations within a blister pack of the present invention.

Referring to FIG. 12, a flow chart of the control system for depositing pills in random locations within a blister pack of the present invention is shown. This process provides for filling random locations of a blister pack with one or more medications. For example, an exemplary prescription (request) requires one medication (pill type) every seven days and two of another medication (pill type) every two days in a 28 compartment blister package. In such, the described process positions the cassette with the first pill type over the target location, then the blister pack is positioned so that the first, eighth, fifteenth, $22^{nd}$, $29^{th}$ location, dropping one pill in each location (or the required number of pills). Next, the cassette with the second pill type is positioned over the target location, then the blister pack is positioned so that the first, third, fifth, etc. location, dropping two pills in each location (or the required number of pills).

(a) First, the request (medication) (total number of pills and target package) is input into the system 260. (b) Next, the pill type destination configuration is determined 262 (e.g., first pill type every seven blister pack locations, etc). (c) Then for each pill type in the request 264 steps d-h are performed. (d) The cassette with the current pill type is positioned over the target location 266 then (e) for each destination in the blister pack that requires the current pill type, (f) the X-Y mechanism positions the destination location beneath the target location 270 and the proper amount of pills (as previously described) are deposited at that location. (g) If there are more destinations for the current pill type 274, then (h) the next location is retrieved 276 and the above steps starting with (f) are repeated. If there are no more destinations for the current pill type 274, then it is determined (g) if there are any more pill types 278. If there are no more pill types 278 for the current request, the process is finished and the request is complete. If there are more pill types, then (h) the cassette with the next pill type is positioned over the target location 280 and the above steps starting with (e) are repeated. In some embodiments, the cassette with the next pill type is in a different pill dispenser and the blister pack is moved to the dispenser having the next pill type and filling continues at that pill dispenser.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of dispensing pills comprising:

(a) inputting a request including at least one pill type and a pill count associated with each of the at least one pill type;

(b) loading a cassette having a first pill type of the at least one pill type over a target location;

(c) positioning a target container beneath the target location;

(d) energizing the cassette to drop one pill into the target container at the target location;

(e) detecting if a pill dropped from the cassette into the target container;

(f) if a pill dropped from the cassette into the target container and there are still more current pill type to drop into the target container, repeating steps d-f without changing the target container at the target location;

(g) if a pill dropped from the cassette into the target container and the number current pill type has satisfied the request, ending;

(h) if a pill dropped from the cassette into the target container and a number of the current pill already dispensed type has not satisfied the request, continuing with step d without changing the target container at the target location;

(i) if no pill dropped, informing an operator;

(j) if the operator indicates that there are still pills in the cassette, processing a jammed cassette;

(k) if the operator indicates the cassette is empty and another cassette has a same pill type, moving the another cassette to the target location and repeating from step d without changing the target container at the target location;

(l) if the operator indicates the cassette is empty and there is no cassette having a same pill type, instructing the operator to refill the cassette;

(m) if the cassette is refilled by the operator, continuing with step d without changing the target container at the target location.

2. The method of claim 1, wherein the drive mechanism for positioning the movable platen is adapted to move the movable platen to a position so any particular blister of a blister pack is positioned at the target location.

3. The method of claim 1, wherein step g comprises the step of determining if the request includes another pill type and, if the request includes the another pill type, positioning another cassette with the another pill type over the target location and continuing with step c without changing the target container at the target location.

4. The method of claim 1, wherein the request includes a target container capacity and step h includes the step of determining if the target container has reached the target container capacity and if the target container has not reached the target container capacity, continuing with step d and if the target container has reached the target container capacity then signaling the operator to provide a new container at the target location then after the operator has provided the new container at the target location, continuing with step d without changing the target container at the target location.

5. The method of claim 1, wherein the target container is a vial.

6. The method of claim 1, wherein the target container is a blister pack and the target container is movable in both an X-direction and a Y-direction, the method further comprising the step of moving the blister pack before the step of energizing the cassette thereby positioning a blister of the blister pack beneath the target location.

7. The method of claim 6, wherein the blister is next to a previous blister of the blister pack.

8. The method of claim 6, wherein the blister is separated from a previous blister of the blister pack by at least one other blister.

9. A method of dispensing pills comprising:

(a) inputting a request including a pill type, a pill count and a target container load count;

(b) loading a cassette having pills of the pill type over a target location;

(c) loading a target container beneath the target location;

(d) energizing the cassette to drop one of the pills into the target container at the target location;

(e) detecting if a pill dropped from the cassette into the target container;

(f) if a pill dropped from the cassette into the target container and there are still more of the current pill type to drop into the target container and the number of pills in the target container is less than the target container load count, continuing with step d without changing the target container at the target location;

(g) if a pill dropped from the cassette into the target container and the number of the current pill type has satisfied the request, ending;

(h) if a pill dropped from the cassette into the target container and the number of the current pill type has not satisfied the request and the number of pills in the target container is greater than or equal to the target container load count:

(i) signaling the operator to provide a new container at the target location;

(j) waiting for the operator to provide the new container at the target location;

(k) continuing with step d without changing the target container at the target location;

(l) if no pill dropped, informing the operator that no pill dropped;

(m) if the operator indicates that there are still pills in the cassette, processing a jammed cassette;

(n) if the operator indicates the cassette is empty and another cassette has the pill type, moving the another cassette to the target location and continuing from step d without changing the target container at the target location;

(o) if the operator indicates the cassette is empty and another cassette has a same pill type and there is no cassette having a same pill type, instructing the operator to refill the cassette; and (p) after the cassette is refilled by the operator, continuing with step d without changing the target container at the target location.

10. The method of claim 9, wherein the target container is a vial.

11. The method of claim 9, wherein the target container is a blister pack and the blister pack is positioned such that a different compartment of the blister pack is located beneath the target location to accept a number of the pills.

* * * * *